United States Patent [19]

Tolle

[11] Patent Number: 4,844,182

[45] Date of Patent: Jul. 4, 1989

[54] METHOD FOR IMPROVING DRILL CUTTINGS TRANSPORT FROM A WELLBORE

[75] Inventor: Glen C. Tolle, Plano, Tex.

[73] Assignee: Mobil Oil Corporation, New York, N.Y.

[21] Appl. No.: 203,184

[22] Filed: Jun. 7, 1988

[51] Int. Cl.[4] ..... E21B 17/18; E21B 7/04

[52] U.S. Cl. ..... 175/215; 175/61; 175/320; 175/38; 175/48

[58] Field of Search ..... 175/215, 320, 61, 314, 175/324, 38, 48

[56] References Cited

U.S. PATENT DOCUMENTS

| | | | |
|---|---|---|---|
| 2,670,180 | 2/1954 | Ranney | 175/61 X |
| 2,786,652 | 3/1957 | Wells | 175/215 X |
| 2,835,328 | 5/1958 | Thompson | 175/314 |
| 3,411,321 | 11/1968 | Schurman | 175/320 X |
| 3,747,698 | 7/1973 | Chapman | 175/215 X |
| 3,902,323 | 9/1975 | Watanabe | 175/314 X |
| 4,246,975 | 1/1981 | Dellinger | 175/61 |
| 4,361,193 | 11/1982 | Gravley | 175/61 |
| 4,368,787 | 1/1983 | Messenger | 175/319 |
| 4,428,441 | 1/1984 | Dellinger | 175/61 |
| 4,473,124 | 9/1984 | Savins | 175/65 |
| 4,496,012 | 1/1985 | Savins | 175/65 |
| 4,615,399 | 10/1986 | Schoeffler | 175/215 X |

OTHER PUBLICATIONS

"Advanced Technology", *Offshore,* Dec. 1987, p. 17, Author: L. A. LeBlanc.

"Increasing Penetration Rates with High-Pressure Mud", R. McNally, *Petroleum Engineer,* Dec. 1987, p. 46–47.

*Primary Examiner*—Stephen J. Novosad

*Attorney, Agent, or Firm*—Alexander J. McKillop; Charles J. Speciale; George W. Hager, Jr.

[57] ABSTRACT

A borehole tool employs a drill string having a plurality of sections of drill pipe connected together for traversing a wellbore. Drilling fluid is circulated down the drill string and up the annulus between the drill string and the wellbore to transport entrained drill cuttings out of the wellbore. At least one section of double wall drill pipe with its outer wall perforated, is included in the drill string. Drilling fluid flow down the string into the section of double wall drill pipe is controlled to effect a desired degree of drilling fluid flow rate through the perforations in the outer wall of the double wall drill pipe section so as to provide a stirring action to the drill cuttings in the wellbore annulus and thereby improve the transport of entrained drill cuttings out of the wellbore in the circulating drilling fluid.

4 Claims, 4 Drawing Sheets

METHOD FOR IMPROVING DRILL CUTTINGS TRANSPORT FROM A WELLBORE

BACKGROUND OF THE INVENTION

In the drilling of wells into the earth by rotary drilling techniques, a drill bit is attached to a drill string, lowered into a well, and rotated in contact with the earth; thereby breaking and fracturing the earth and forming a wellbore thereinto. A drilling fluid is circulated down the drill string and through nozzles provided in the drill bit to the bottom of the wellbore and thence upward through the annular space formed between the drill string and the wall of the wellbore. The drilling fluid serves many purposes including cooling the bit, supplying hydrostatic pressure upon the formations penetrated by the wellbore to prevent fluids existing under pressure therein from flowing into the wellbore, reducing torque and drag between the drill string and the wellbore, maintaining the stability of open hole (uncased) intervals, and sealing pores and openings penetrated by the bit. A most important function is hole cleaning (carrying capacity), i.e. the removal of drill solids (cuttings) beneath the bit, and the transport of this material to the surface through the wellbore annulus.

Reduced bit life, slow penetration rate, bottom hole fill up during trips, stuck pipe, and lost circulation, can result when drill solids are inefficiently removed in the drilling of vertical boreholes. The efficiency of cuttings removal and transport becomes even more critical in drilling the deviated or inclined wellbore, particularly when the inclination is greater than 60 degrees, because as cuttings settle along the lower side of the wellbore, this accumulation results in the formation of a cutting bed. If the drill pipe lies on the low side of an open hole interval (positive eccentricity), drill solids concentrate in the constricted space and conditions susceptible to differential sticking of the pipe can also occur. Hole cleaning can also be a problem under conditions where the drill string is in tension and intervals of negative eccentricity result as the drill string is pulled to the high side of the annulus. In the latter situation, the drill string is not usually in direct contact with the cuttings bed, but the latter's presence can lead to incidents of stuck pipe when circulation is stopped to pull out of the hole.

Various methods have been proposed for improving the efficiency of cuttings removal from the wellbore, including, promoting the formation of a particular flow regime throughout the annulus, altering the rheology of the entire drilling fluid volume, increasing the annular velocity, rotating pipe, and combinations thereof. In the case of the inclined wellbore, U.S. Pat. Nos. 4,246,975 and 4,428,441 to Dellinger, teach the use of eccentric drill string members to stir up the cuttings bed, thus aiding cuttings removal. U.S. Pat. No. 4,473,124 to Savins teaches that hole cleaning efficiency is increased by increasing the yield point to plastic viscosity ratio of the drilling fluid while maintaining the plastic viscosity constant. U.S. Pat. No. 4,496,012 to Savins teaches the injection of shear thickening fluid ahead of the drilling fluid to increase cuttings transport efficiency. U.S. Pat. No. 4,361,193 to Gravley teaches the incorporation of one or more fluid nozzles in the drill string for directing a portion of the drilling fluid circulating in the drill string outwardly into the annulus of the wellbore about the drill string so as to effect a stirring action on the drill cuttings and improve their removal by the return flow of the drilling fluid.

SUMMARY OF THE INVENTION

The present invention is directed to the removal of earth formation drill cuttings from a wellbore formed during the drilling of a wellbore through a subsurface formation. More particularly a drill string employs a plurality of sections of drill pipe connected together for traversing the wellbore. Drilling fluid is circulated down the drill string and up the annulus between the drill string and the wellbore to transport entrained drill cuttings out of the wellbore.

At least one section of double wall drill pipe is included in the drill string thereby forming a first drilling fluid conduit within an inner wall of the double wall drill pipe and a second drilling fluid conduit between the inner wall and an outer wall of the double wall drill pipe. The outer wall contains a plurality of perforations through which drilling fluid flowing through the second conduit is radially directed into the wellbore annulus to cause a stirring action to the drill cuttings within the drilling fluid in the wellbore annulus surrounding such perforations for improving the transport of drill cuttings out of the wellbore by such drilling fluid.

In a further aspect, control is provided for the relative drilling fluid flows through each of the conduits of the double wall drill pipe. In this aspect, the flow rate of the drilling fluid through the perforations in the outer wall is controlled so as to effect the degree of stirring action to the drill cuttings within the drilling fluid flow up the wellbore annulus.

DESCRIPTION OF THE PREFERRED EMBODIMENT

Figure 1:
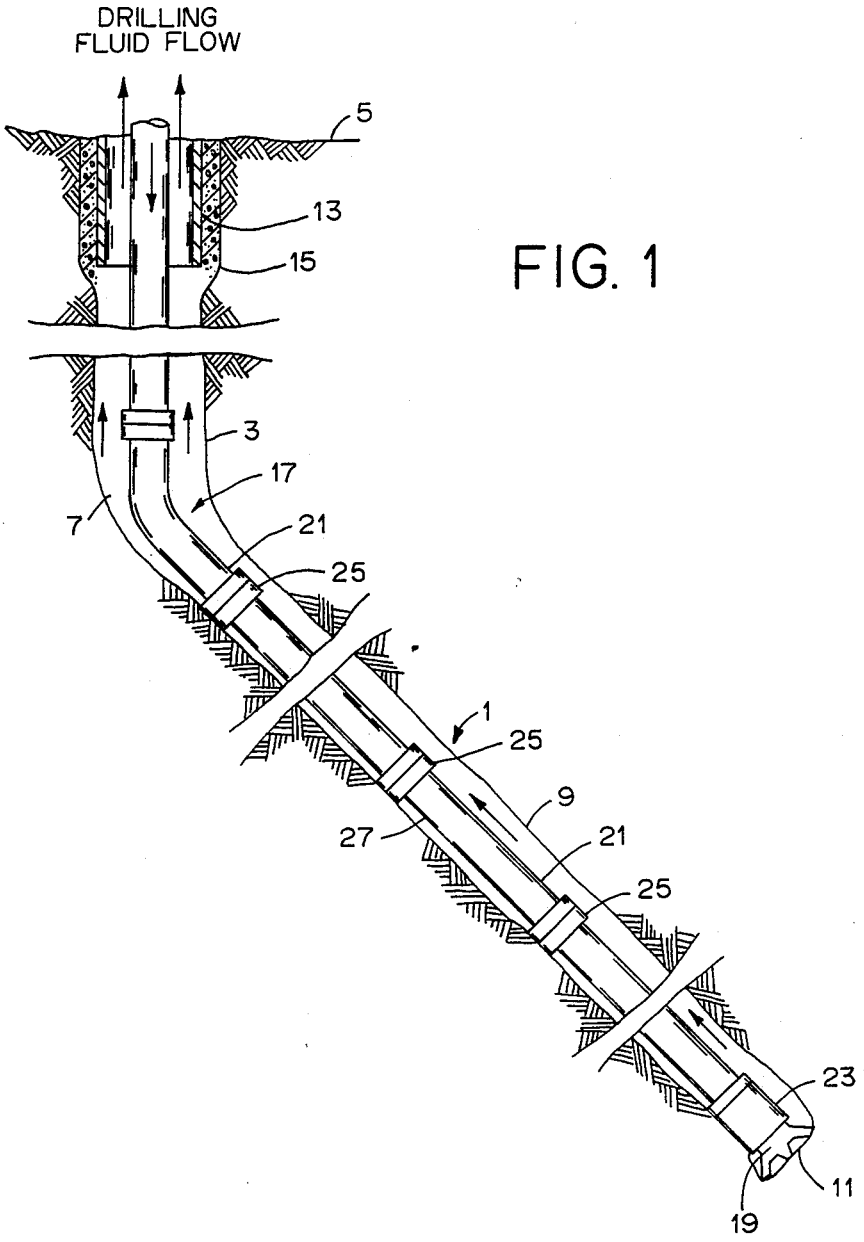
FIG. 1 illustrates a drill string lying along the lower side of a deviated wellbore extending into the earth.

Referring to FIG. 1 there is illustrated a conventional drill string used in the rotary drilling of a wellbore, particularly a deviated wellbore. A deviated wellbore 1 has a vertically first portion 3 which extends from the surface 5 of the earth to a kick-off point 7 and a deviated second portion 9 of the wellbore which extends from the kick-off point 7 to the wellbore bottom 11. Although the illustrated embodiment shows a wellbore having a first vertical section extending to a kick-off point, the teachings of the present invention are applicable to other types of wellbores as well. For instance, under certain types of drilling conditions involving porous formations and large pressure differentials, the teachings herein may be applicable to vertical wellbores. Also some deviated wellbores need not have the first vertical section illustrated in FIG. 1.

A shallow or surface casing string 13 is shown in the wellbore surrounded by a cement sheath 15. A drill string 17, having a drill bit 19 at the lower end thereof, is positioned in the wellbore 1. The drill string 17 is comprised of drill pipe sections 21 and the drill bit 19, and will normally include at least one drill collar 23. The drill pipe sections 21 are interconnected together by tool joints 25, and the drill string may also include wear knots for their normal function. In the deviated second portion 9, the drill string normally rests on the lower side 27 of the wellbore. Drill cuttings are removed from the wellbore bottom 11 by circulating drilling fluid, as shown by the arrows.

Figure 2:
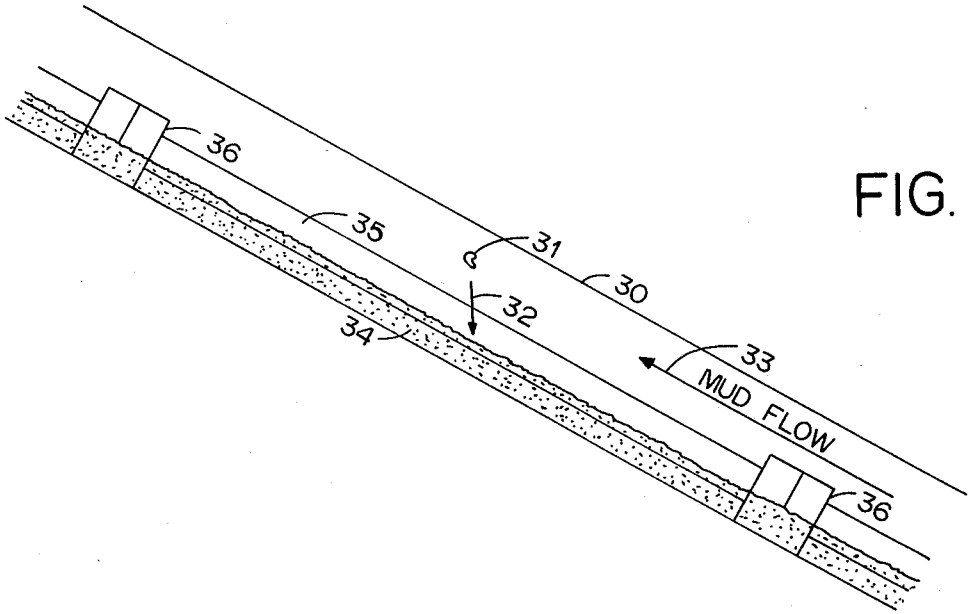
FIG. 2 illustrates a cuttings bed buildup around the drill string of FIG. 1 during rotary drilling operations.

It is a common occurrence in the drilling of high-angle boreholes to have difficulty in removing the drill cuttings from the wellbore. It can be seen in FIG. 2 that in a deviated wellbore 30 each drill cutting particle 31 will tend to fall (as shown by arrow 32) from the flow of drilling mud up the wellbore (as shown by arrow 33). These particles accumulate on the lower side of the wellbore to form a cuttings bed as shown at 34 beneath and around the drill pipe 35 which also rests along the lower side of the wellbore on the tool joints 36. A normal drilling mud circulation rate is about 100 feet/minute average velocity in the annulus between a 5 inch drill pipe and a nominal 12¼ inch wellbore. This velocity is frequently inadequate to remove the drill cuttings. By increasing the mud flow velocity to 150 feet/minute, cuttings removal has been found to be enhanced. However, problems are experienced at the greater flow rate. Pump pressures increase dramatically causing added expenditure of power and maintenance. The wellbore may not be able to support this increased pressure without breakdown of the formation and subsequent loss of drilling mud circulation.

Also, any decrease in the size of the annulus will cause both a pressure and velocity increase in the drilling mud flow. For example, the mud flow velocity of 100 feet/minute around the 5 inch drill pipe will increase to about 115 feet/minute about a 6⅜ inch tool joint and to about 145 feet/minute about an 8 inch drill collar. In addition, if the 12¼ inch wellbore were reduced to 11¼ inch, the mud flow velocity would be about 123 feet/minute about the 5 inch drill pipe, 145 feet/minute about the 6⅜ inch tool joint and 198 feet/minute about the 8 inch drill collar. These velocity changes are even more pronounced in drilling a 9-7/8inch wellbore with 5-inch drill pipe.

To overcome such problems of drill cuttings removal in wellbore drilling operations and in subsequent cleaning operations, particularly in wellbores deviated up to the horizontal, the present invention provides for the imparting of a stirring action to the drill cuttings in the drilling mud flow up the wellbore annulus. This stirring action improves the transport of drill cuttings entrained in the drill fluid out of the wellbore.

Figure 3:
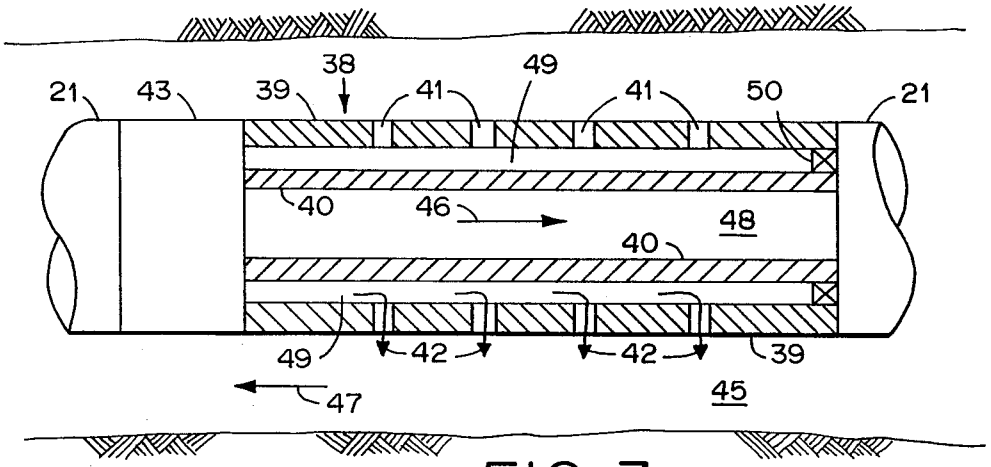
FIG. 3 illustrates the apparatus of the present invention for use in removing drill cuttings formed during rotary drilling operations such as shown in FIG. 2.

Referring now to FIG. 3 there is diagrammatically shown the apparatus of the present invention for use in a drill string of the type shown in FIG. 1 for providing a stirring action to the drill cuttings to improve their transport out of the wellbore in the drill fluid during a rotary drilling operation or during a borehole cleaning operation without drilling. At least one section 38 of double wall drill pipe (shown in cross section in FIG. 3) is affixed between conventional drill pipe sections 21. Double wall drill pipe 38 includes an outer wall 39 and an inner wall 40. A diverter sub 43 controls the amount of drilling fluid flow through an inner fluid conduit 48 within the inner wall 40 as shown by the arrow 46 and through an outer fluid conduit 49 between the inner and outer walls 40 and 39 respectively as shown by the arrows 42. The fluid flow 46 in the inner conduit flows down the remaining sections of drill pipe 21 and exits the lower end of the drill string where it begins its return up the wellbore annulus 45 with entrained drill cuttings as shown by arrow 47. The drilling fluid flow 42 in the outer conduit 49 is preferably prevented from flowing on down the drill string by fluid blocking member or packer 50 and radially exits conduit 49 through a plurality of perforations 41 in the outer wall 39 so as to enter the wellbore annulus as shown by the arrows 42. In this manner, the drilling fluid flow 42 through perforations 41 impinges directly on the drill cuttings within the annulus 45 surrounding perforations 41. The rate of drill fluid flow 42 through perforations 41 is controlled by the number and size of the perforations 41 in conjunction with the amount of drilling fluid passed into outer conduit 49 through diverter sub 43 so as to provide a desired stirring action to the drill cuttings in the wellbore annulus 45 for improving the drill cuttings transport out of the wellbore within the drilling fluid flow 47. The perforations 41 may be circular holes, slots, or any other desired geometrical configuration. The perforations 41 may be perpendicular or oblique to the outer wall 39 and may be spaced-apart along the length or about the circumference of the outer wall 39 as necessary.

Figure 4:
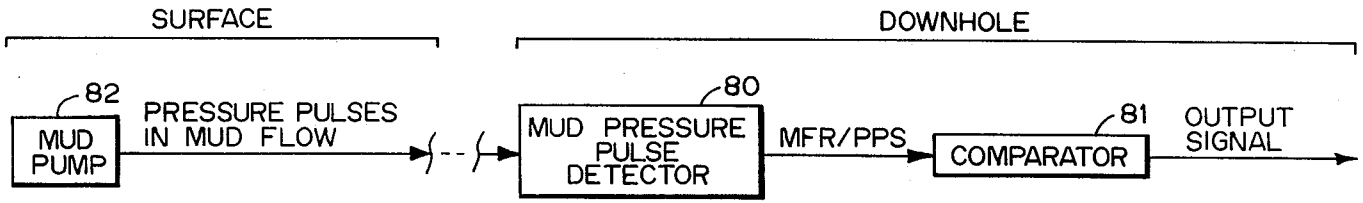
FIG. 4 illustrates an embodiment of a communication channel in the drilling fluid flow for effecting control of the apparatus of FIG. 3.

Control of the amount of drilling fluid flow from the diverter sub 43 into the outer conduit 48 so as to effect the flow rates through perforations 41 may be by way of a suitable communication channel from the surface of the earth. One such communication channel is by way of the drilling mud as taught in U.S. Pat. No. 3,800,277 to Patton et al and which is incorporated herein by reference. Briefly, however, such patent teaches the use of pressure pulses in the drilling mud as such a communication channel. As shown in FIG. 4, a downhole mud pressure pulse detector 80 provides an electrical signal, MFR, which is proportional to the flow rate of the drilling mud. Such flow rate is controlled from the mud pump 82 on the surface of the earth as shown in FIG. 4. Such MFR signal is applied to comparator 81 which provides an output signal whenever the mud flow rate equals or exceeds a select rate, such as 200 gallons per minute for example. Details of the electrical configuration of such mud pressure pulse detector 80 and comparator 81 are shown in U.S. Pat. No. 3,800,277. The signal from comparator 81 may be used by diverter sub 43 to control the flow of drilling mud into one or both of conduits 48 and 49.

In another aspect the controlling signal could be a Programmed Pulsing Sequence, PPS, to signal the desired control to diverter sub 43.

It is also a specific feature of the present invention to control the stirrings of drill cuttings within the drilling mud flow at various positions along the wellbore and for periods of activity other than during drilling so as to optimize the removal of such drill cuttings from the wellbore. For example, additional drilling mud flow rate is needed into the borehole annulus when the drill string is being pulled out of the wellbore and encounters an accumulation of cuttings in the borehole that restricts the upward passage of the drill string.

In a further example, increased drilling mud flow is effected at the bottom of a known washout in the wellbore wall so that such increased flow can be used to clean the wellbore at this position where the washout could be expected to cause a cuttings accumulation. The diverter sub 43 could be controlled upon command to effect a cleaning of the wellbore in the vicinity of the washout before tripping out of the wellbore or to simply clean the wellbore at any time.

In another aspect, this mud flow rate control into the wellbore annulus surrounding the perforated double wall drill pipe is carried out to increase the flow in the borehole annulus without increasing flow through the drill bit or around the drill collars.

In addition to controlling the drilling mud flow rate, other types of communication channels may be utilized with the present invention to control diverter sub 43. Such communication channels may include electrical signal transmissions down the drill string, or electromechanical, radio, or acoustic signals through the earth formations surrounding the wellbore.

Dual wall drill pipe, diverter subs and fluid blocking members or packers are all conventional components supplied by numerous well drilling equipment manufacturers and suppliers as listed in *Composite Catalog of Oil Field Equipment and Services,* 36th Revision, 1984–85, published by World Oil, Houston, Tex. One such manufacturer and supplier of double wall drill pipe and subs is Walker-Neer Manufacturing Co., Inc., Wichita Falls, Tex., found on pages 7425–7436 of such catalog. Two recent articles on the use of double wall drill pipes for increasing drilling penetration rate are "Increasing Penetration Rates With High-Pressure Mud", *Petroleum Engineer International,* December 1987, pgs. 46–47 and "Advanced Technology", *Offshore,* December 1987, pg. 17.

While a preferred embodiment of a wellbore tool for improving drill cuttings removal has been described herein, it will be apparent to those skilled in the art that various changes and modifications may be made without departing from the spirit and scope of the invention as set forth in the appended claims.

I claim:

1. Apparatus for removing earth formation drill cuttings from a wellbore formed during the drilling of the wellbore, comprising:

(a) a drill string having a plurality of sections of drill pipe connected together traversing a wellbore, (b) means for circulating drilling fluid down the drill string and up the annulus between the drill string and the wellbore to transport entrained drill cuttings out of the wellbore, (c) at least one section of double wall drill pipe included in said drill string, thereby forming a first drilling fluid conduit within an inner wall of said double wall drill pipe and a second drilling fluid conduit between said inner wall and an outer wall of said double wall drill pipe, (d) a plurality of perforations in said outer wall through which drilling fluid flowing through said second conduit is directed into the wellbore annulus so as to cause a stirring action to drill cuttings in said wellbore annulus surrounding said perforations for improving the transport of said drill cuttings out of the wellbore by the circulating drilling fluid, and (e) means for controlling the relative drilling fluid flows through each of said first and second conduits of said double wall drill pipe.

2. The apparatus of claim 1 further including means for controlling th flow rate of drilling fluid through said perforations so as to effect control of the degree of stirring action to said drill cuttings in the annulus of said wellbore surrounding said double wall drill pipe.

3. The apparatus of claim 2 wherein said flow rate is controlled to provide direct impingement of the drilling fluid flowing through said perforations onto said drill cuttings in the annulus of the wellbore surrounding said double wall drill pipe.

4. The apparatus of claim 2 further including means for blocking the drilling fluid flow in said second conduit to thereby cause said drilling fluid to radially exit said second conduit through said perforations into the annulus of said wellbore surrounding said double wall drill pipe.

* * * * *